US005119574A

United States Patent [19]

King

[11] Patent Number: 5,119,574

[45] Date of Patent: Jun. 9, 1992

[54] COLLECTOR'S ALBUM HAVING TRANSPARENT DISPLAY PAGES WITH SHEET RETAINERS

[75] Inventor: Michael J. King, Flossmoor, Ill.

[73] Assignee: U.S. Sample Company, Chicago, Ill.

[21] Appl. No.: 627,299

[22] Filed: Dec. 14, 1990

[51] Int. Cl.[5] ..... G09F 19/00

[52] U.S. Cl. ..... 40/537; 40/159; 206/39; 206/454; 206/470; 281/21.1; 281/45; 402/4

[58] Field of Search ..... 40/394, 395, 396, 397, 40/398, 400, 401, 403, 404, 405, 409, 156, 158.1, 530, 533, 534, 535, 536, 537, 159, 159.2, 389, 388; 402/74, 75, 4, 500; 281/23, 21.1, 45, 46, 42, 48, 49, 38, 39.5, 45.34; 206/39, 454, 449, 470, 472, 473

[56] References Cited

U.S. PATENT DOCUMENTS

| | | | |
|---|---|---|---|
| 2,311,646 | 2/1943 | De Sherbinin | 40/159.2 |
| 2,521,792 | 9/1950 | Hollander | 40/536 X |
| 3,371,439 | 3/1968 | Smith et al. | 40/159 X |
| 3,604,556 | 9/1971 | Schwartz | 206/45.34 X |
| 3,727,334 | 4/1973 | Sakamoto | 40/536 |
| 3,956,836 | 5/1976 | Seaborn | 40/530 |
| 4,322,001 | 3/1982 | Hurley | 206/45.34 |
| 4,524,867 | 6/1985 | Klein et al. | 206/45.34 X |
| 4,602,447 | 7/1986 | Feingold | 40/404 X |
| 4,829,691 | 5/1989 | Manjos et al. | 40/661 |
| 4,979,619 | 12/1990 | Hager | 206/39 X |

FOREIGN PATENT DOCUMENTS

| | | | |
|---|---|---|---|
| 634307 | 4/1963 | Belgium | 40/537 |
| 835127 | 11/1964 | Canada | 49/403 |
| 3607664 | 9/1987 | Fed. Rep. of Germany | 281/45 |

*Primary Examiner*—Kenneth J. Dorner
*Assistant Examiner*—James M. Gardner

[57] ABSTRACT

A collector's album includes a binder and at least one display page having a plurality of pockets to receive collectible display items such as sports cards, stamps, slides, and the like. Each display page has transparent front and back panels with the front panels having pockets defined by recessed base surfaces and peripheral retaining walls. Retaining members are cooperative with the peripheral retaining walls to releasably retain display items and associated transparent display covers within the corresponding pockets. In one embodiment, transparent lids are hinged to the front panel to overlie the pockets and retain collectible items within the pockets for display.

10 Claims, 3 Drawing Sheets

COLLECTOR'S ALBUM HAVING TRANSPARENT DISPLAY PAGES WITH SHEET RETAINERS

BACKGROUND OF THE INVENTION

The present invention relates generally to albums for presenting collectible items in a display format, and more particularly to a novel collector's album including one or more generally rigid display pages having discrete pockets adapted to releasably retain collectible items in the form of display cards, stamps, coins and photographic slides and the like.

It is a common practice for collectors to display various types of collectible items in a format which facilitates viewing of the items. For example, it is a common practice for collectors of coins and stamps to display them in an album format so as to allow viewing and selective withdrawal as when trading or selling to other collectors. More recently, it has become a popular hobby, and in some instances one's primary vocation, to collect and trade and/or sell cards displaying likenesses of athletes and having biographical and sports data thereon. Traders of such cards, generally termed sports cards, frequently store the cards in boxes which requires setting the cards out on a table or the like to facilitate viewing. Alternatively, such cards can be inserted in conventional photo albums so that the cards may be viewed by would-be traders or purchasers. Conventional photo albums, however, generally provide for insertion of photos or card type items within discrete rectangular pockets created by securing flexible plastic sheet material to a paperboard type backing so as to establish three closed edges and an open edge about each pocket. Or the photos may be arranged on a backing after which a single transparent plastic sheet of similar size, which is secured along one edge to an edge of the backing sheet, is caused to overlie and retain the photos against the backing. In either case, removal of the photos or cards from the album is generally inconvenient and time consuming. Moreover, when removed, the photos or cards are not protected from finger prints or soiling.

Certain types of commercial products also lend themselves to marketing through the use of binder type displays which assist perspective purchasers in making selections. For example, in selecting many types of home and commercial decorations and furnishings, it is common practice to display color swatches and/or fabric samples in a binder format along with information relating to the samples and/or corresponding products. Accordingly, an album which provides improved display characteristics and which facilitates ease of removal and insertion of various display items would provide a marked improvement over known albums.

SUMMARY OF THE INVENTION

One of the primary objects of the present invention is to provide a novel album which finds particular application as a collector's album and provides improved visibility of the displayed items.

A more particular object of the present invention is to provide a novel album having improved display pages which define generally rigid discrete pockets for receiving and displaying collectible items and which enable viewing of the displayed items from both front and back sides thereof.

Another object of the present invention is to provide an album which finds particular application as a collector's album and which includes one or more display pages each of which is made of a generally rigid sheet material formed to define a plurality of discrete pockets to receive collectible items, the pockets having recessed generally planar transparent base surfaces and a peripheral retaining wall having retaining means to releasably retain a display item and associated transparent cover when disposed within the corresponding pocket.

Another object of the present invention is to provide a novel method for displaying collector items in an album format.

Another object of the present invention is to provide novel covers for collector display items which protect the display items and facilitate placement in display pages of an album.

A feature of the display pages employed in the album of the present invention lies in forming the display pages from relatively rigid transparent plastic which lends itself to vacuum forming so as to define a plurality of display pockets and associated retaining members to releasably retain display items within the pockets such that they can be viewed from both their front and back surfaces and can be readily withdrawn from the corresponding pockets.

A feature of one embodiment of the album in accordance with the present invention lies in forming the pockets within the display pages such that each pocket has a retaining wall peripherally of its transparent recessed base surface, and has retaining means formed on the peripheral retaining wall for releasably retaining a hinged transparent lid or cover in closed position overlying a display item disposed within the corresponding pocket, the transparent cover being releasable to enable withdrawal of the displayed item.

Further objects, features and advantages of the present invention will become apparent from the following detailed description when taken in conjunction with the accompanying drawings wherein like reference numerals designate like elements throughout the several views.

DETAILED DESCRIPTION

Figure 1:
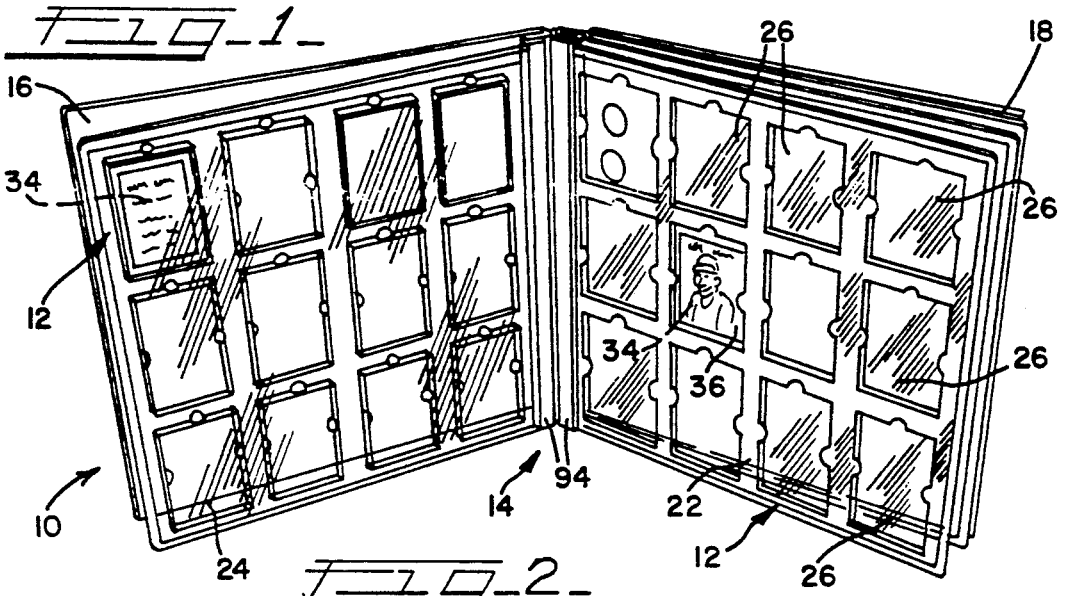
FIG. 1 is a perspective view of an album constructed in accordance with one embodiment of the present invention, the album being shown in an open position to enable viewing of the front surfaces of items displayed on one display page while enabling viewing of the back surfaces of items displayed on the next preceding display page.
Figure 3:
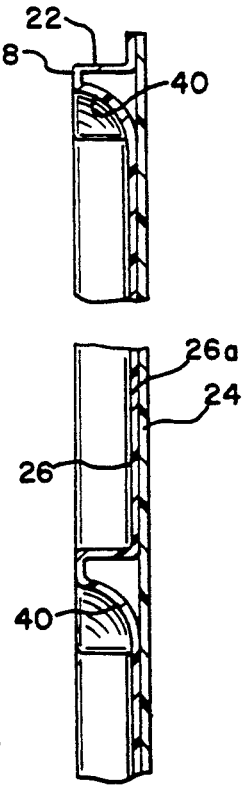
FIG. 3 is a fragmentary sectional view taken along line 3—3 of FIG. 2.

Referring now to the drawings, an album constructed in accordance with one embodiment of the present invention is indicated generally at 10 in FIG. 1. The album 10 finds particular application as a collector's album for displaying collectible items such as generally rectangular flat cards having, for example, likenesses of athletes and associated biographical and sports related statistics printed thereon. Such cards are frequently termed "sports cards". As will become apparent, the album 10 may also be utilized to display various other collectible items such as coins and/or currency, stamps, photo slides and microscopic slides and the like as employed in biological studies. One feature of the album 10 lies in the ability to view the displayed items both from their front surfaces and their back surfaces as illustrated in FIG. 3.

In the illustrated embodiment, the album 10 includes a plurality of display pages 12 which are releasably supported in an album arrangement by a binder 14 between front and back covers 16 and 18, respectively. The front and back covers 16 and 18 are preferably made of a relatively stiff planar material, such as a suitable paperboard, having an outer covering composed of vinyl or other suitable material.

The display pages 12 are substantially identical in construction and are formed from a suitable transparent plastic sheet material, such as vacuum formable polyethylene. Each display page includes a front panel 22 and a planar back or rear panel 24 which are of substantially equal rectangular size and are secured together in superimposed relation along their peripheral marginal edges by suitable binding means, such as heat sealing.

Figure 2:
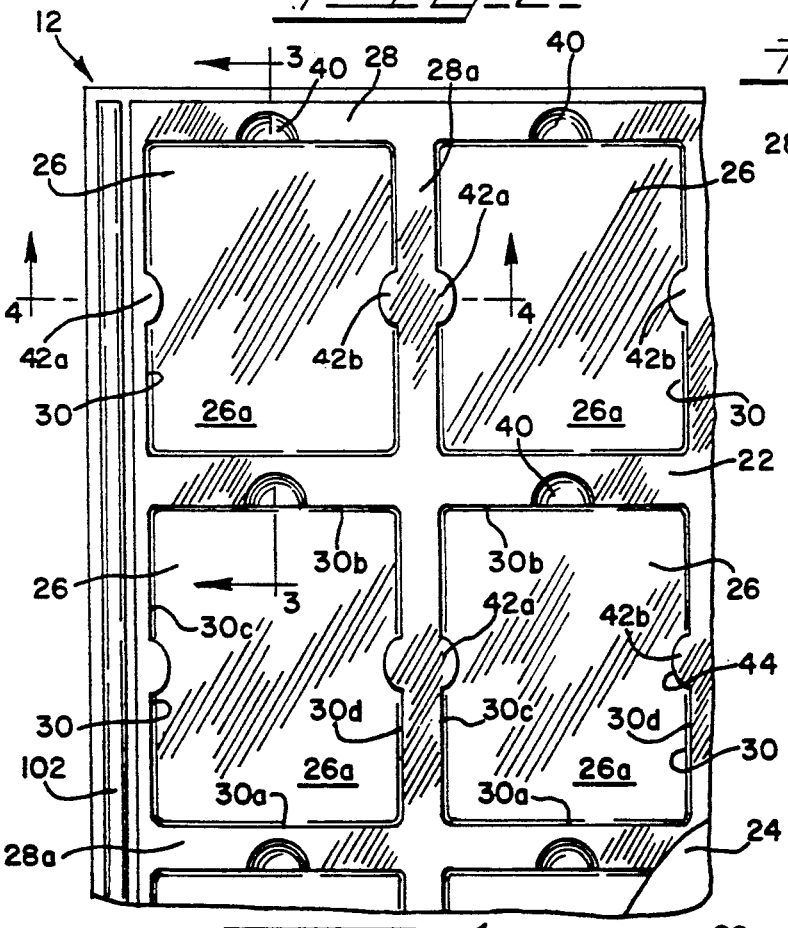
FIG. 2 is a fragmentary front elevational view of a display page employed in the album of FIG. 1.

The front panel 22 may be vacuum formed to establish a plurality of discrete rectangular pockets 26 having transparent planar base surfaces 26*a* which are depressed or recessed from an upper surface 28. In the illustrated embodiment, the rectangular pockets 26 ar of equal size and are equally spaced apart by equal width co-planar surfaces 28*a* which collectively comprise the upper surface 28 of the front panel. The perimeter or boundary of each of the rectangular pockets 26 is defined by a peripheral retaining wall 30 which, when the associated display page is in a generally vertical orientation such as illustrated in FIG. 2, defines a bottom boundary wall 30*a*, an opposite parallel upper boundary wall 30*b*, and a pair of laterally opposite vertical side walls 30*c* and 30*d*, all of which are normal to the upper panel surface 28 and the base surface 26*a* of the corresponding pocket.

The pockets 26 may be sized to receive predetermined display items. In the illustrated embodiment, the pockets 26 are particularly sized to receive generally rectangular flat cards 34 having likenesses of athletes or other personalties on their front surfaces and corresponding biographical and/or sports related statistics printed on their back surfaces. Each card 34 is retained within a protective transparent holder or cover, such as indicated at 36 in FIG. 5, having a similar size rectangular configuration and closed about three edges with the fourth edge open to enable insertion of the card. The holders 36 are preferably made of a transparent vinyl plastic so that viewing of both sides of the associated display card is not inhibited. The rectangular holders or covers 36 are similar in size to the display page pockets 26 so that each card 34 and its associated holder may be inserted into a pocket and lie flat against the corresponding base surface 26*a*. To facilitate entry of a display card 34 and its associated holder 36 within a pocket, a finger recess 40 is formed in the front panel 22 generally mid-length of each of the pocket boundary walls 30*b*. Each finger recess 40 may be formed as a segment of a spherical surface and preferably extends to the corresponding recessed base surface 26*a*.

Figure 4:
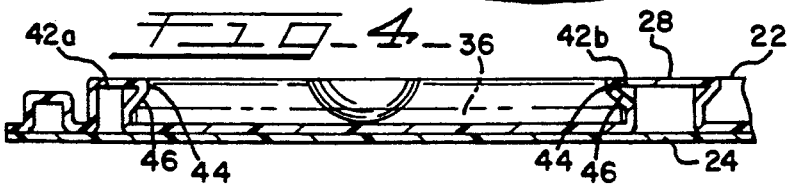
FIG. 4 is a fragmentary sectional view taken substantially along line 4—4 of FIG. 2, a collector item and associated cover being shown in phantom.

To retain a display card 34 and its associated holder or casing 36 within a pocket 26 of a display page 12, retainer means in the form of a pair of laterally opposed retaining members 42*a* and 42*b* are formed generally mid-length of the laterally opposed boundary walls 30*c* and 30*d* of each pocket. As illustrated in FIG. 4, each of the retaining members 42*a* and 42*b* may be formed integral with the front panel 22 so as to establish an arcuate upper wall 44 intersected by an inclined wall 46 which intersects the corresponding boundary wall 30*c* or 30*d* along a line of intersection parallel to the corresponding base surface 26*a* and spaced from the corresponding base surface a distance generally equal to the thickness of a display card and its associated holder. When inserting a display card 34 and its associated transparent holder 36 into a pocket 26, the holder is inserted adjacent the end of the pocket in which the finger recess 40 is formed and is urged longitudinally into the pocket such that the laterally opposite side edges of the holder engage the inclined surfaces 46 of the corresponding retaining members 42*a* and 42*b*. The inclined surfaces 46 cam the display card downwardly into the associated pocket and retain it against the corresponding base surface 26*a* until removed by insertion of a finger into the finger recess 40 and grasping and removal of the display card.

The front panel 22 of the display page 12 may be vacuum formed from a suitable strength transparent plastic sheet so as to provide a relatively rigid transparent front panel. By providing the recessed pockets 26 with peripheral boundary surfaces 30*a–d*, desired rigidity is imparted to the front panel 22. In the preferred embodiment, the planar rectangular rear panel 24 is made from transparent plastic sheet, such as polyethylene, and has its outer marginal edges secured to the corresponding outer marginal edges of the front panel 22 to add rigidity to the display page as well as providing a planar surface on which additional informational data may be applied, as through labels or direct printing or the like.

Figure 5:
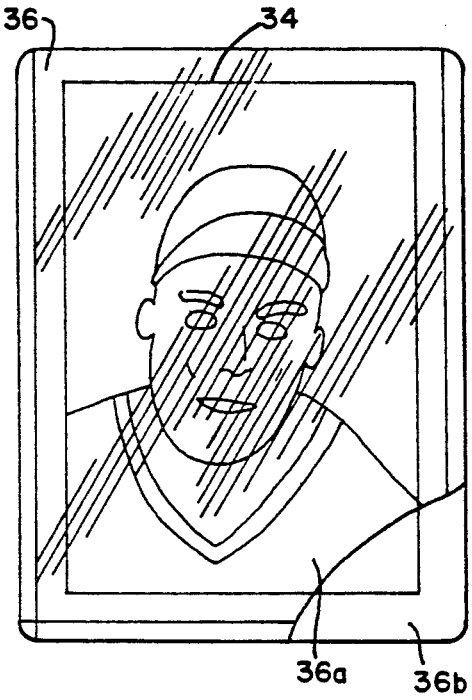
FIGS. 5–9 illustrate various types of covers for receiving flat card and coin type collectible items which may be then retained within display pockets in display pages of the type illustrated in FIGS. 1 and 2.

FIGS. 5–9 illustrate alternative covers or holders for various collectible display items which may be inserted within pockets 26 in a display page 12 of the album 10. FIG. 5 illustrates the rectangular cover or holder 36 which has superimposed front and back rectangular panels 36*a* and 36*b* of suitable transparent vinyl plastic secured together, as by heat sealing along three marginal edges so as to define an open-ended relatively rigid cover or holder for receiving a rectangular display card or the like.

Figure 6:
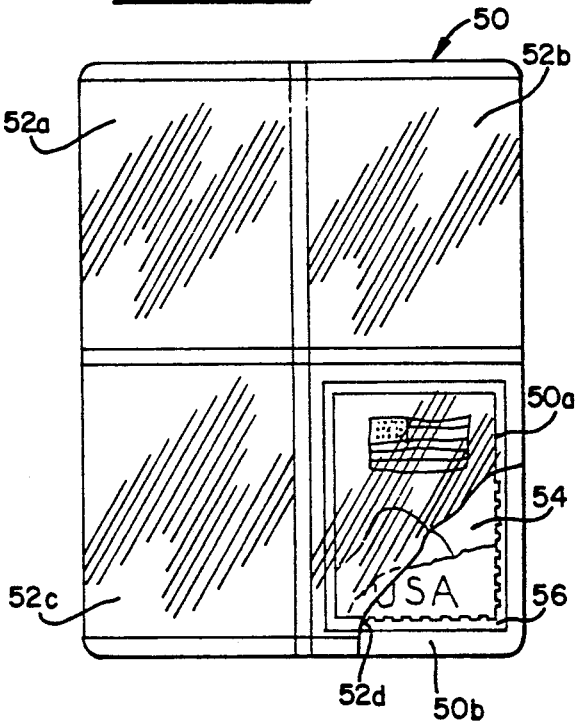

FIG. 6 illustrates a transparent relatively rigid vinyl plastic cover or holder 50 which is particularly suited for retaining collector stamps and the like after which the holder may be inserted into a pocket 26 in a display page 12. The cover or holder 50 includes superimposed front and back rectangular panels 50*a* and 50*b* of transparent vinyl plastic which are secured together, as be heat sealing, through lines of attachment along top and bottom marginal edges and along longitudinal and transverse center axes so as to create four stamp receiving compartments 52*a–d* each of which is open along an outer edge to facilitate insertion of a stamp. For optimum display purposes, the collector stamps, one of which is illustrated at 54, are mounted on opposite sides of a similar size rectangular opaque backing 56 which is then inserted into a compartment 52*a–d*. In this manner collector stamps may be viewed from both sides of the cover or holder 50.

Figure 7:
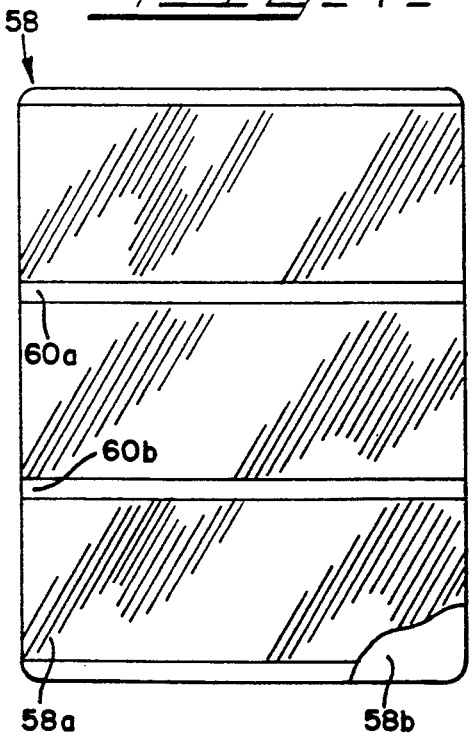

FIG. 7 illustrates a relatively rigid transparent cover or holder 58 adapted to receive three biology slides or the like. The holder 58 is similarly made from front and back rectangular transparent vinyl panels 58*a* and 58*b* which are secured together, as by heat sealing, along lines of attachment at upper and lower transverse marginal edges and along intermediate transverse lines of attachment 60*a* and 60*b*, thereby establishing open-ended compartments sized to receive biology slides. The slide holder 58 is also sized to enable insertion into a pocket 26 in a display page 12 and be retained therein by the corresponding retaining members 42*a* and 42*d*.

Figure 8:
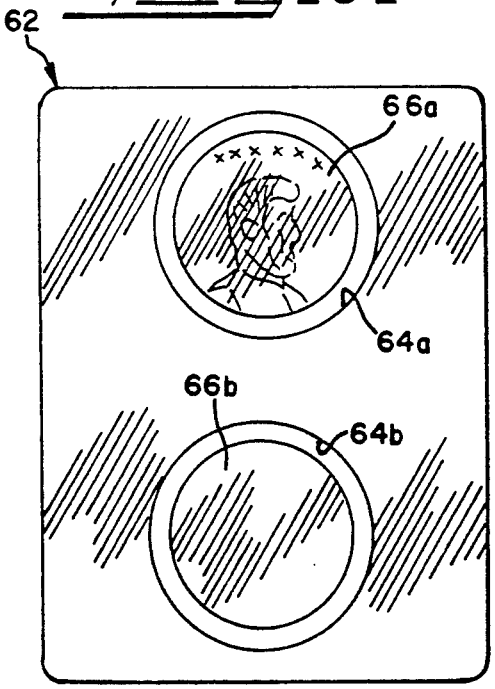

FIG. 8 illustrates a relatively rigid transparent vinyl holder 62 for collector coins and the like. Holder 62 has a generally flat rectangular configuration sized to be inserted within a pocket 26 in a display page 12. The coin holder 62 may be made from a single thickness of relatively rigid transparent plastic or from laminated transparent plastic layers, and has at least one circular aperture formed therethrough. In the illustrated embodiment, a pair of circular apertures 64*a* and 64*b* are formed in the rectangular holder 62 and are sized to receive and frictionally retain circular coin holders 66*a* and 66*b* which may encapsulate collector coins or the like and thereby facilitate retention and display of the coins within a pocket 26 in a display page 12.

Figure 9:
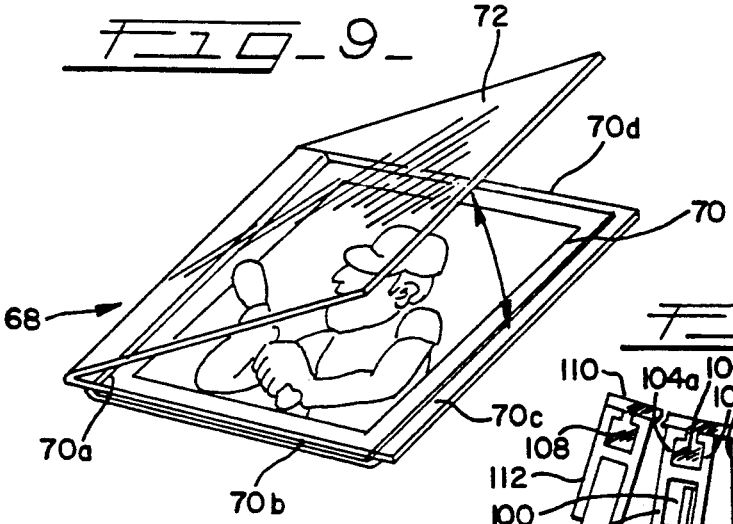

FIG. 9 illustrates another cover or holder, indicated generally at 68, adapted to receive a sports card 34 or the like after which the card and holder 68 may be inserted within a pocket 26 in a display page 12 of the album 10. The cover or holder 68 is made of a suitable vacuum formable transparent vinyl plastic formed to establish a clam-shell type configuration having a shallow rectangular pocket 70 bounded by co-planar peripheral edges 70*a–d*. A transparent rectangular cover or lid 72 may be formed integral with or otherwise secured along one edge to a lateral peripheral edge of the pocket so as to establish a hinge axis. The cover or lid 72 is adapted to closely overlie the upper surface of a card 34 inserted within the pocket.

Figure 10:
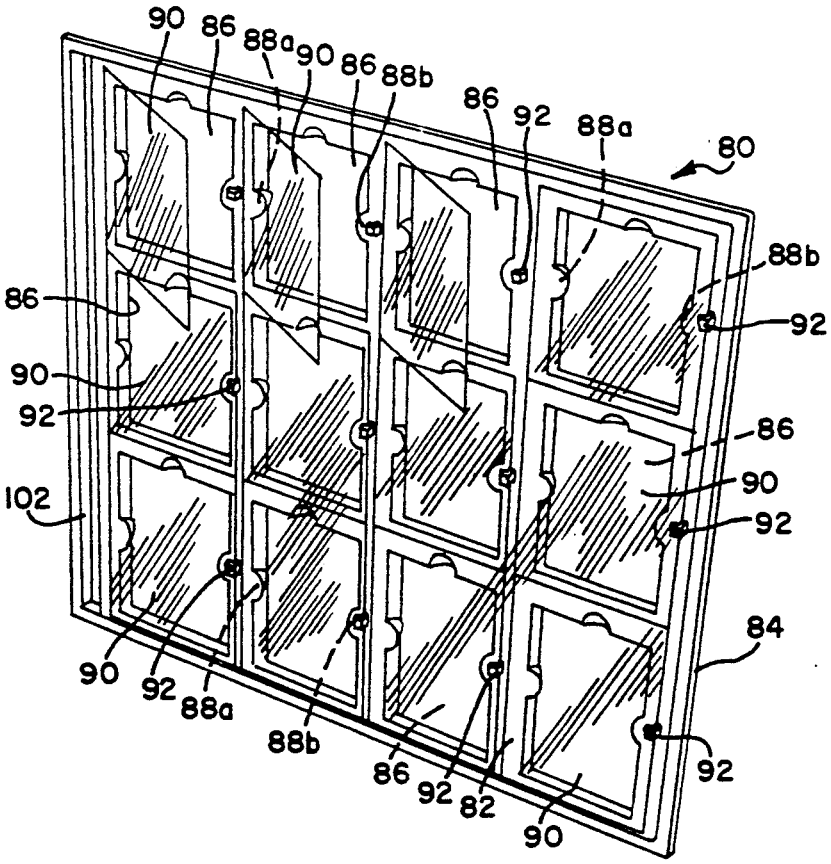
FIG. 10 is a fragmentary front elevational view of an alternative display page having a transparent cover hinged to the display page adjacent each display pocket and adapted to cover the corresponding pocket when in closed relation.

FIG. 10 illustrates an alternative display page, indicated generally at 80, adapted to receive and display generally flat collectible items in similar fashion to the display pages 12. The display page 80 is of similar rectangular size to the display pages 12 and has relatively rigid rectangular front and back panels 82 and 84 which may be made from transparent vinyl plastic sheet material and are secured together in superimposed relation, as by heat sealing, along their marginal edges in similar fashion to the panels 22 and 24 of the display pages 12. The front panel 82 is vacuum formed to create a plurality of pockets 86 defined by transparent base surfaces and corresponding peripheral retaining walls having oppositely disposed retaining members 88*a* and 88*b* formed thereon similar to the retaining members 42*a,b*. The back panel 84 is preferably planar. A relatively rigid transparent rectangular lid 90 is suitably secured along one edge to the front panel 82 adjacent each pocket 86 so as to establish hinge-type connections enabling movement of the lids between open positions allowing insertion of display cards or other collectible items within the corresponding pockets, and closed positions closely overlying the display cards. A suitable retaining catch 92 is formed along the edge of each pocket 8 opposite the hinge axis of the associated lid 90, so as to cooperate with the free edge of the corresponding lid and releasably retain it in a closed position. In this manner, generally flat collectible items may be displayed within the pockets 86 without need for separate holders of the type illustrated in FIGS. 5–9.

Figure 11:
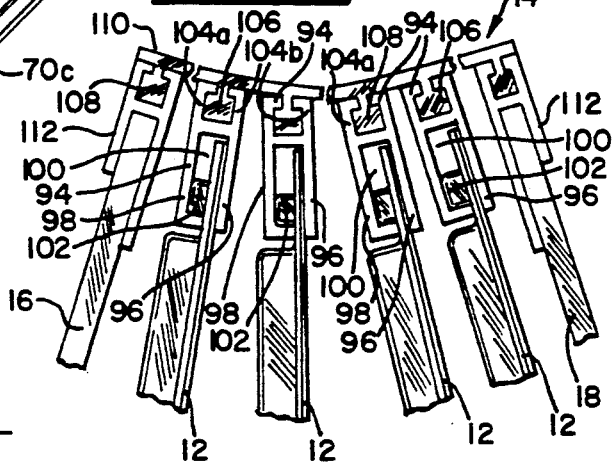
FIG. 11 is a fragmentary plan view, on an enlarged scale, illustrating one embodiment of a binder for retaining a plurality of display pages in album form.

FIG. 11 illustrates one type of binder 14 which may be employed to retain a plurality of display pages 12 and/or 80 in an album format between the front and back covers 16 and 18. The binder 14 may be substantially identical to the binder disclosed in pending application, Ser. No. 07/610,513, filed Nov. 8, 1990, which is incorporated herein by reference. Briefly, the binder 14 includes a plurality of substantially identical elongated channel members 94 which may be made of extruded relatively rigid plastic. Each channel member 94 has a generally planar wall 96 and a generally L-shaped wall 98 which cooperate to define a longitudinal channel 100. Each of the display pages 12 and 80 has a raised elongated connector rib 102 formed adjacent its left-hand edge, as viewed from the front as in FIGS. 2 and 10, which is adapted for insertion within channel 100 of a channel member 94 so as to releasably mount the display page to the channel member.

Each of the channel members 94 also has a pair of generally L-shaped connector flanges 104*a* and 104*b* formed as integral extensions of the walls 96 and 98 so as to define on elongated T-shaped connection channel 106 along a longitudinal edge. The channels 106 are each adapted to receive a T-shaped male connector element 108 formed integral with a flexible spine 110 so as to retain the corresponding display pages 12 and/or 80 in an album format. The front and back covers 16 and 18 may be secured to the spine 110 through channel connector members 112 in similar fashion to the channel members 94. An album assembly is thus created having a plurality of display pages and front and back covers which are hingedly connected to each other.

Having thus described various embodiments of an album which finds particular use in displaying collectible items, it will be understood to those skilled in the art that changes and modifications may be made therein without departing from the invention in its broader aspects. Various features of the invention are defined in the following claims.

What is claimed is:

1. A collector's album comprising, in combination, at least one display page having a relatively rigid transparent front panel and a relatively rigid transparent back panel, said front panel having a plurality of discreet generally rectangular pockets formed therein to receive display items, each of said pockets having a generally planar transparent recessed base surface bounded by a peripheral retaining wall having laterally opposite retaining wall surfaces, a retaining member formed on each of at least two of said laterally opposite retaining wall surfaces, said back panel being generally planar and secured to said front panel along peripheral marginal edges of said front and back panels, and at least one transparent display cover adapted to receive a display item and having a size enabling the display cover to be inserted within a selected one of said pockets, said retaining members corresponding to said selected pocket cooperating with said display cover to urge the display cover toward the base surface of the corresponding pocket during insertion therein and releasably retain the display item within the corresponding pocket.

2. A collector's album as defined in claim 1 including a plurality of said display pages each of which is generally rectangular.

3. A collector's album as defined in claim 1 wherein said pockets are of generally equal size and are uniformly spaced on the display page.

4. A collector's album as defined in claim 1 wherein each of said retaining members defines a cam surface operative to urge a display cover toward the base surface of the corresponding pocket when inserted therein.

5. A collector's album as defined in claim 1 including a finger access formed in the retaining wall peripherally of each of said pockets to facilitate removal of display items from the associated pockets.

6. A collector's album comprising, in combination, at least one display page including a relatively rigid transparent front panel and a relatively rigid transparent back panel, said front panel having a plurality of pockets formed therein to receive display items, said back panel being generally planar and secured to said front panel along peripheral marginal edges of said front and back panels, each of said pockets being defined by a recessed base surface and a retaining wall peripherally of the recessed base surface, retaining means cooperative with the retaining wall peripherally of each of said pockets, and at least one transparent display cover adapted to receive a display item and being sized for insertion within a selected one of said pockets in cooperating relation with the corresponding retaining means in a manner to releasably retain the display cover within the selected pocket, and a transparent lid hinged to said front panel adjacent each of said pockets and adapted to overlie the corresponding pocket so as to overlie a display cover and associated display item when disposed within the corresponding pocket.

7. A collector's album as defined in claim 6 including a plurality of said display pages each of which has an elongated rib formed along a marginal edge thereof, and binder means cooperative with said elongated ribs in a member to retain said pages in album form.

8. A collector's album as defined in claim 7 wherein said binder includes means for supporting relatively stiff front and back covers outwardly of said display pages.

9. A collector's album comprising, in combination, a binder, at least one display page secured to said binder, said display page including a transparent front panel and a transparent back panel, said front panel having a plurality of pockets formed therein to receive display items, said back panel being generally planar and secured to said front panel along peripheral marginal edges of said front and back panels, said pockets each facing outwardly from the side of said front panel opposite said rear panel and being defined by a generally planar transparent recessed base surface and a retaining wall peripherally of the recessed base surface, a pair of retaining members formed on the retaining wall peripherally of each pocket so as to form oppositely disposed retaining members overlying the corresponding pocket base surface, at least one transparent display cover adapted to receive a display item therein and being adapted for insertion within a selected one of said pockets, each of said retaining members defining a cam surface cooperative with the corresponding display cover in a manner to urge the display cover toward the base surface of the corresponding pocket when inserted therein and releasably retain the display cover within the selected pocket.

10. A collector's album as defined in claim 9 wherein said pockets are of generally equal rectangular size and are uniformly spaced on the display page.

* * * * *